US010952588B2

(12) United States Patent
Balz

(10) Patent No.: US 10,952,588 B2
(45) Date of Patent: Mar. 23, 2021

(54) FLOOR CARE TOOLS

(71) Applicant: Ecolab USA Inc., Saint Paul, MN (US)

(72) Inventor: Eric R. Balz, Saint Paul, MN (US)

(73) Assignee: Ecolab USA Inc., Saint Paul, MN (US)

( * ) Notice: Subject to any disclaimer, the term of this patent is extended or adjusted under 35 U.S.C. 154(b) by 87 days.

(21) Appl. No.: 16/209,015

(22) Filed: Dec. 4, 2018

(65) Prior Publication Data

US 2019/0167063 A1 Jun. 6, 2019

Related U.S. Application Data

(60) Provisional application No. 62/594,185, filed on Dec. 4, 2017.

(51) Int. Cl.

| | |
|---|---|
| ***A47L 13/52*** | (2006.01) |
| ***A46B 15/00*** | (2006.01) |
| ***A47L 13/512*** | (2006.01) |
| ***A46B 17/02*** | (2006.01) |
| ***B25G 1/10*** | (2006.01) |

(52) U.S. Cl.

CPC ..... *A47L 13/52* (2013.01); *A46B 15/00* (2013.01); *A46B 15/0055* (2013.01); *A46B 17/02* (2013.01); *A47L 13/512* (2013.01); *B25G 1/10* (2013.01); *A46B 2200/302* (2013.01)

(58) Field of Classification Search

CPC ..... A46B 15/00; A46B 15/0055; A46B 17/02; A46B 2200/302; A47L 13/52; A47L 13/512; B25G 1/10; B25H 3/04; A45F 5/14

See application file for complete search history.

(56) References Cited

U.S. PATENT DOCUMENTS

| | | | | |
|---|---|---|---|---|
| 2,376,955 | A * | 5/1945 | Ball | A47B 81/005 211/60.1 |
| 9,532,694 | B1 * | 1/2017 | Shippen | A47L 13/52 |
| 10,166,670 | B2 * | 1/2019 | Larsson | B25H 3/003 |
| 2003/0167588 | A1 * | 9/2003 | Perelli | A47L 13/52 15/257.7 |

FOREIGN PATENT DOCUMENTS

| | | | |
|---|---|---|---|
| CN | 202078267 | U | 12/2011 |
| JP | 2005245665 | A | 9/2005 |
| KR | 200357760 | | 7/2004 |
| WO | 03059141 | A1 | 7/2003 |
| WO | 2016115474 | A1 | 7/2016 |

* cited by examiner

*Primary Examiner* — Shay Karls

(74) *Attorney, Agent, or Firm* — McKee, Voorhees & Sease, PLC

(57) ABSTRACT

A floor care tool set includes generally complementary floor care tools, such as a broom and a receptacle for receiving items moved by the broom. To hold the tools together, such as when not in use, a clip is used to at least temporarily connect handles of the tools to one another. The clip includes an element such as a magnet that attracts the handle of one of the tools to hold the tool in place at the magnet. The clip may be attached to the other tool in a more permanent, but still removable, manner. The tools may also include grip portions that interact with one another to provide another location of connection. The clip can also be attached to a wall mount or generally inverted to be hung on a surface.

16 Claims, 16 Drawing Sheets

FLOOR CARE TOOLS

CROSS-REFERENCE TO RELATED APPLICATIONS

This application claims priority under 35 U.S.C. § 119 to provisional application U.S. Ser. No. 62/594,185, filed Dec. 4, 2017. The priority patent application is herein incorporated by reference in its entirety, including without limitation, the specification, claims, and abstract, as well as any figures, tables, appendices, or drawings thereof.

FIELD OF THE INVENTION

The invention relates generally to the field of floor care and cleaning. More particularly, but not exclusively, the invention relates to complementary floor care tools for use in cleaning floors.

BACKGROUND OF THE INVENTION

Floor care tools, such as mops, brooms, and other tools used to clean floors are used in a variety of home and commercial situations. Some tools, which may be referred to generally as complementary tools, include a broom and a dustpan/lobby pan tool set, which can include a handle attached to a dustpan. The broom, which includes a separate handle, is used to sweep debris, dust, particulate matter, trash, or anything else into the dustpan for disposal into another container.

To keep the broom and dustpan with one another, they may be tethered, attached, or otherwise kept together. Known systems tend to have poorly designed clips and methods to attach the components, which may prevent them from staying together. Separating the components increases the possibility of misplacing one or both of the components, which greatly reduces the effectiveness of their use.

Still further, known systems may not be able to be stored in a convenient manner. The components may be propped against a wall or in a corner, or may be crudely hung to a hook or other wall attachment.

Therefore, there is a need in the art for a system, method, and/or apparatus for combining multiple floor care tools having complementary uses. There is also a need in the art for a system, method, and/or apparatus to aid in storing the complementary tools that will keep them together in an efficient manner.

SUMMARY OF THE INVENTION

Therefore, it is a primary object, feature, and/or advantage of the disclosure to overcome deficiencies in the art.

It is another object, feature, and/or advantage of the disclosure to provide improved systems, methods, and/or apparatus for connecting complementary floor care tools.

According to aspects of the disclosure, a floor care tool set is provided. The floor care tool set includes a first floor care tool comprising an elongated handle with a first floor care tool head positioned at a first end of the handle; a second floor care tool comprising an elongated handle and a second floor care tool head positioned at a first end of the handle; and a clip attached to the handle of the first or second floor care tool, said clip comprising a housing operatively connected to the handle with said housing including a concave portion for receiving a portion of the first or second handle, and at least one holding element associated with the concave portion to hold one of the first or second handles within the concave portion.

Some embodiments include wherein said clip is attached to the second floor care tool, and the concave portion of the clip is configured to receive a portion of the handle of the first floor care tool.

Additional embodiments include wherein the at least one holding element comprises at least one magnet operatively positioned with respect to the clip housing.

Still additional embodiments include wherein the at least one magnet is positioned at or near the interior-most point of the concave portion.

Further embodiments include wherein the at least one magnet comprises first and second magnets positioned generally across from one another and interiorly facing with respect to the concave portion.

Still further embodiments include wherein the handle of the first and second floor care tools comprises steel.

Even further embodiments include wherein the clip comprises a hook opposite the concave portion.

More embodiments include wherein the first floor care tool head comprises a broom, and the second floor care tool comprises a receptacle.

Still more embodiments further comprise a mounting member positioned at a second end of the first floor care tool handle.

Even more embodiments comprise a grip positioned at the second end of the second floor care tool, said grip comprising an extension that intersects the mounting member of the first floor care tool.

Additional embodiments include wherein the grip includes an elongated hand portion opposite the extension, wherein said elongated hand portion is configured to fit a contour of a user's hand.

According to additional aspects of the disclosure, a combination of a first floor care tool comprising an elongated handle, and a second floor care tool comprising an elongated handle is provided. The combination includes a clip for temporarily connecting the first and second floor care tools, said clip comprising: a housing surrounding the handle of the first or second floor care tool; a concave surface extending from a first end of the housing; a generally downward facing hook on a second end of the housing; and a holding element operatively positioned relative to the concave surface to temporarily connect the first and second floor care tools.

Additional embodiments of the combination include that the holding element comprises a magnet within the housing.

Further embodiments of the combination include that the magnet is positioned opposite the opening of the concave surface.

Still further embodiments of combination include that the holding element comprises first and second magnets within the housing on opposite sides of the concave surface.

Even further embodiments of the combination include that the housing comprises first, and second sections attached to one another around a portion of the handle of the first or second floor care tool.

Still even further embodiments of the combination include a hanging element, wherein said hanging element is operatively connectable to the second end of the housing of the clip.

According to still additional aspects of the disclosure, a floor care tool set is provided, and includes a first floor care tool comprising an elongated handle with a first floor care tool at a first end of the handle; a second floor care tool comprising an elongated handle with a second floor care tool at a first end of the handle; and a clip attached to a portion of the handle of the second floor care tool, said clip comprising a housing attached to the handle, a generally concave portion extending from a first end, a holding element associated with the concave portion, and a second end having a notch or hook; wherein the clip connects the first and second floor care tools by removably attaching the handle of the first floor care tool at least partially within the concave portion of the clip and being held, at least in part, by the holding member.

Embodiments of the floor care tool set include that the holding element comprises first and second magnets on opposite inner sides of the concave portion of the clip, and said handle of the first floor care tool comprising steel.

Additional embodiments of the floor care tool set include that said first floor care tool comprises a broom and said second floor care tool comprises a receptacle.

These and/or other objects, features, and advantages of the present invention will be apparent to those skilled in the art. The present invention is not to be limited to or by these objects, features and advantages. No single embodiment need provide each and every object, feature, or advantage.

Figure 1:
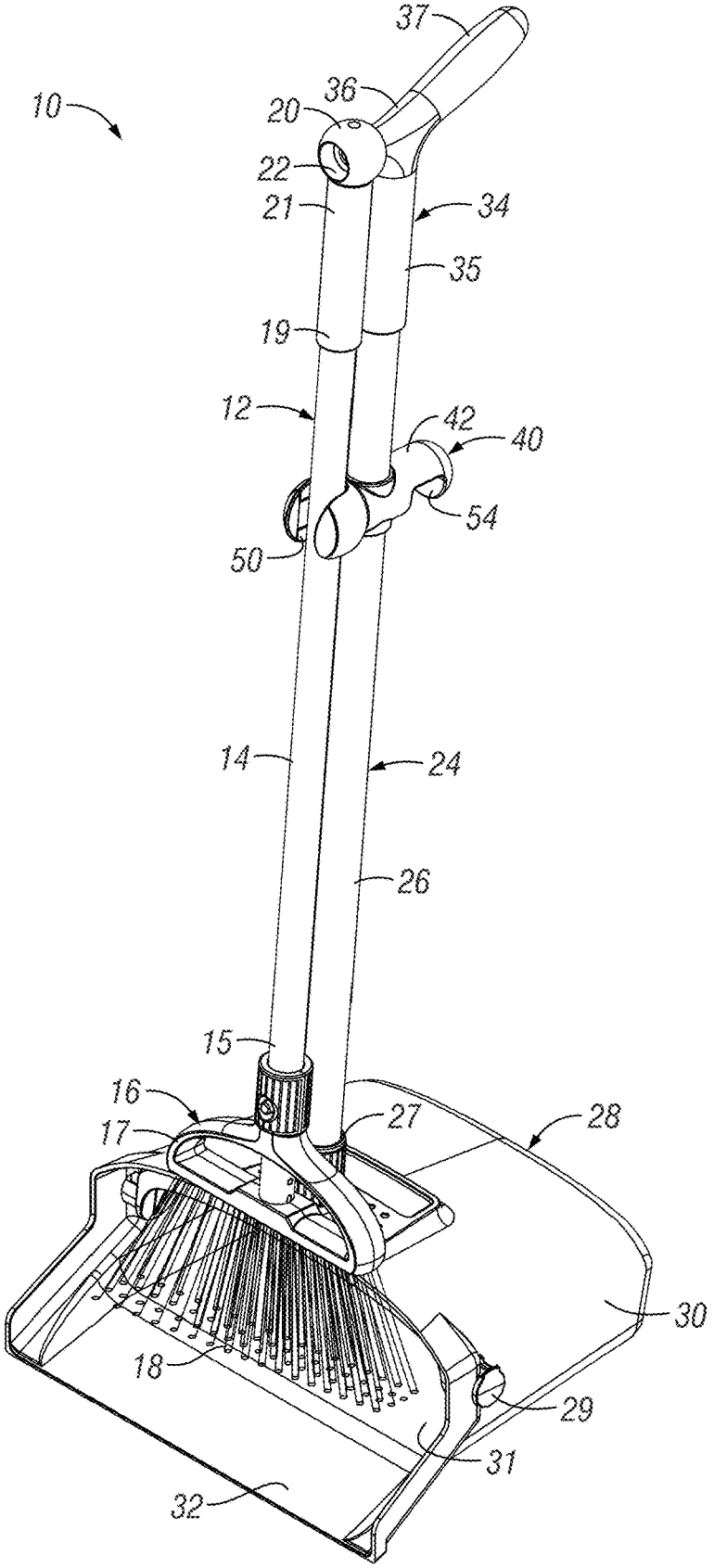
FIG. 1 is a perspective view of a floor care tool set according to aspects of the present disclosure.

Various embodiments of the present invention will be described in detail with reference to the drawings, wherein like reference numerals represent like parts throughout the several views. Reference to various embodiments does not limit the scope of the invention. Figures represented herein are not limitations to the various embodiments according to the invention and are presented for exemplary illustration of the invention.

DETAILED DESCRIPTION OF THE PREFERRED EMBODIMENTS

The following definitions and introductory matters are provided to facilitate an understanding of the present invention. Unless defined otherwise, all technical and scientific terms used herein have the same meaning as commonly understood by one of ordinary skill in the art to which embodiments of the present invention pertain.

The terms "a," "an," and "the" include plural referents unless context clearly indicates otherwise. Similarly, the word "or" is intended to include "and" unless context clearly indicate otherwise. The word "or" means any one member of a particular list and also includes any combination of members of that list.

The terms "invention" or "present invention" as used herein are not intended to refer to any single embodiment of the particular invention but encompass all possible embodiments as described in the specification and the claims.

The term "about" as used herein refers to variation in the numerical quantities that can occur, for example, through typical measuring techniques and equipment, with respect to any quantifiable variable, including, but not limited to, mass, volume, time, distance, wave length, frequency, voltage, current, and electromagnetic field. Further, given solid and liquid handling procedures used in the real world, there is certain inadvertent error and variation that is likely through differences in the manufacture, source, or purity of the ingredients used to make the compositions or carry out the methods and the like. The claims include equivalents to the quantities whether or not modified by the term "about."

The term "configured" describes an apparatus, system, or other structure that is constructed to perform or capable of performing a particular task or to adopt a particular configuration. The term "configured" can be used interchangeably with other similar phrases such as constructed, arranged, adapted, manufactured, and the like.

Terms such as first, second, vertical, horizontal, top, bottom, upper, lower, front, rear, end, sides, concave, convex, and the like, are referenced according to the views presented. These terms are used only for purposes of description and are not limiting unless these terms are expressly included in the claims. Orientation of an object or a combination of objects may change without departing from the scope of the invention.

The apparatuses, systems, and methods of the present invention may comprise, consist essentially of, or consist of the components of the present invention described herein. The term "consisting essentially of" means that the apparatuses, systems, and methods may include additional components or steps, but only if the additional components or steps do not materially alter the basic and novel characteristics of the claimed apparatuses, systems, and methods.

The following embodiments are described in sufficient detail to enable those skilled in the art to practice the invention however other embodiments may be utilized. Mechanical, procedural, and other changes may be made without departing from the spirit and scope of the invention. Accordingly, the scope of the invention is defined only by the appended claims, along with the full scope of equivalents to which such claims are entitled.

The disclosure presents aspects, embodiments, and the like for floor care tools. In particular, but not exclusively, the floor care tools may be complementary style tools that may be attached to one another to store or otherwise move said tools. For example, such complementary tools are tools that may be used in conjunction with one another and therefore, it may be be advantageous to make sure that the tools stay together when not in use. Thus, when the tools are to be used, they can be easily found and quickly and efficiently used. Such examples of tools may include, but are not limited to, a broom and a receptacle, such as a dust pan. The tools are complementary in that the broom is used to sweep matter, such as particulate matter, trash, or the like, and then the broom moves the matter into the dust pan receptacle for emptying into a larger receptacle at a later time. As the tools are used in conjunction with one another, they are considered complementary. Therefore, aspects and embodiments of the present disclosure provide for ways to maintain the combination of such complementary tools.

FIGS. 1-4 show various views of complementary tools being connected and disconnected from one another according to the aspects of the present disclosure. While particular types of complementary tools are shown in the figures, it should be contemplated and envisioned that these not be limiting on the disclosure, and that aspects of the disclosure can be used with generally any type of tools to which it is desired to attach or otherwise store together.

Therefore, the figures show a floor care tool set 10. The floor care tool set 10 includes first and second floor care tools 12, 24. The first floor care tool 12 is shown to be a broom. The broom 12 includes an elongated handle 14 having a first end 15 and a second end 19. At or near the first end 15 of the elongated handle 14 is a tool head 16. The tool head 16 includes a frame 17 to which are attached bristles 18. Again, while a broom is shown as the first floor care tool 12, it should be envisioned that generally any type of floor care tool can be utilized. Examples of such floor care tools may be found in co-owned U.S. application Ser. No. 14/996,993, which is hereby incorporated by reference in its entirety. The floor care tool may also be connected to the handle in a manner separate from that disclosed in the '993 disclosure. For example, the tool head may be connected without threading, and instead be connectable by a fastener such as a snap button (e.g., snap button used with tent pole fasteners) or other tent pole clips. Other snaps, clips, and mechanical fasteners could be used to connect the handle and the tool head or heads.

At the second end and 19 of the elongated handle 14 is a mounting member 20. As disclosed in corresponding U.S. application Ser. No. 14/996,993, the mounting member 20 can be utilized to be mounted to a puck member or other storage component. This will further be described in greater detail herein. Also shown near the second end 19 is a grip type overmolded portion 21. The overmolded portion 21 may include overmolding of rubber or plastic on top of a portion of the elongated handle. This may provide for attaching means of the mounting member 20 or otherwise provide a grip or gripping portion for the first floor care tool 12. For example, the handle may comprise aluminum, steel, combination, or other rigid materials. Also shown is an aperture 22 in the mounting member 20, which will be used as disclosed herein to provide additional connecting portions with the second floor care tool 24.

The second floor care tool 24 is shown to be a dust pan or other receptacle member for receiving trash, particulate matter, or other matter that is swept up or otherwise corralled by the first floor care tool 12. The second floor care tool 24 also includes an elongated handle 26 with a first end 27 and an opposite second end 35. The handle, similar to that of the first floor care tool 12, may comprise aluminum, steel, steel with an aluminum sleeve, steel with a plastic sleeve, other ferrous materials, or other combination. For example, a steel sleeve could be positioned for a length within an aluminum handle. The steel sleeve could be attached at or near a rivet that is used to attach the grip portion of the floor care tool to the handle, and could extend either part way or fully related to the length of the handle. Positioned at or near the first end 27 is a receptacle member 28. Their receptacle member includes a housing 30, which is used to receive the trash or other particulate matter. The handle 26 is operably attached to the housing 30 such as by a hinge or yoke 29. As is known, a yoke can be used to allow for a pivoting attachment between the housing 30 and the handle 26 to allow for the receptacle 28 to be rotatably or hingeably connected to said handle 26. This will allow for greater maneuverability and/or storage for the floor care tool set 10. The receptacle 28 also includes an opening 31 with a ramp 32 extending generally therefrom. The ramp provides a surface extending towards a floor or other surface to allow for the particulate matter to be directed into the receptacle 28 to be of the opening 31. It should be appreciated that the receptacle may take many forms of sizes, shapes, and the like, and that which is shown is not limiting on the disclosure.

Positioned generally at the second end 35 of the elongated handle 24 is a grip portion 34. The grip portion 34 may include an overmolded or otherwise cap type member for covering at least a portion of the elongated handle 24. At a distal end of the grip 24 is a beak or extension 36 and a hand portion 37. As will be understood, the beak portion 36 is configured to generally mate or otherwise interact with the aperture 22 of the mounting member 20 of the first floor care tool 12. The handle portion 37 is a contoured portion to generally correspond with a hand of a user. This will allow for greater comfort and ergonomic advantages for use of the floor care tool set and components thereof. However, the hand portion 37 need not be required and generally otherwise may take any shape or form to allow for use of the second floor care tool 24.

The elongated handles 14, 26 of the first and second floor care tools 12, 24 comprise a rigid material, which may include steel. Still further, it is contemplated that one or both of the elongated handles 14, 26 comprise an inner layer of steel surrounded by an outer layer of plastic, other metals (e.g., aluminum), rubber, or the like. Such incorporation of steel with one or both of the elongated handles 14, 26 of the first and second floor care tools 12, 24 will be useful for combining said complementary style tools in a manner as shown and described herein.

For example, an aspect of the disclosure includes the incorporation of a clip 40 attached or otherwise positioned at one of the handles of the first or second floor care tool. This can be at generally any location along the longitudinal length of the handles. As shown in FIGS. 1-4, the clip 40 is generally positioned on and about the elongated handle 26 of the second floor care tool 24. However, it should be appreciated that the clip 40 could also be positioned on the handle 14 of the first floor care tool 12 with the components thereof generally reversed. The clip 40 provides for unique aspects for at least temporarily attaching or otherwise affixing the first and second floor care tools 12, 24 such as that shown in FIGS. 1 and 4. Such attachment will allow for better storage and/or transport of the tools to maintain the combination of the first and second floor care tools such that the complementary tools will remain a set for use thereof. Furthermore, as will be understood, the clip 40 provides for easy separation of the first and second floor care tools 12, 24 such that the use thereof will not be prohibited or otherwise negatived by such use of the clip.

Figure 3:
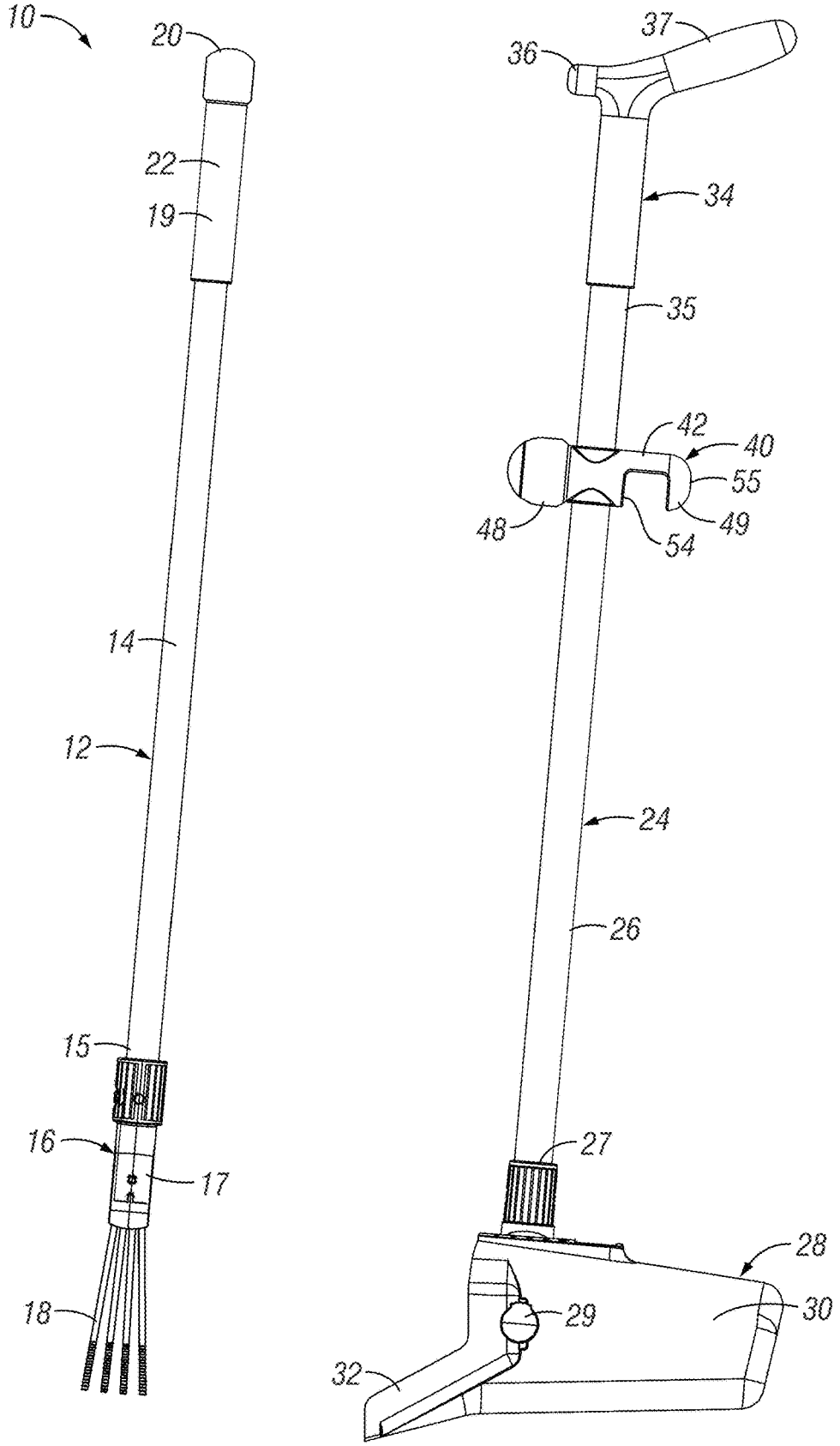
FIG. 3 is a side elevation view of FIG. 2.
Figure 4:
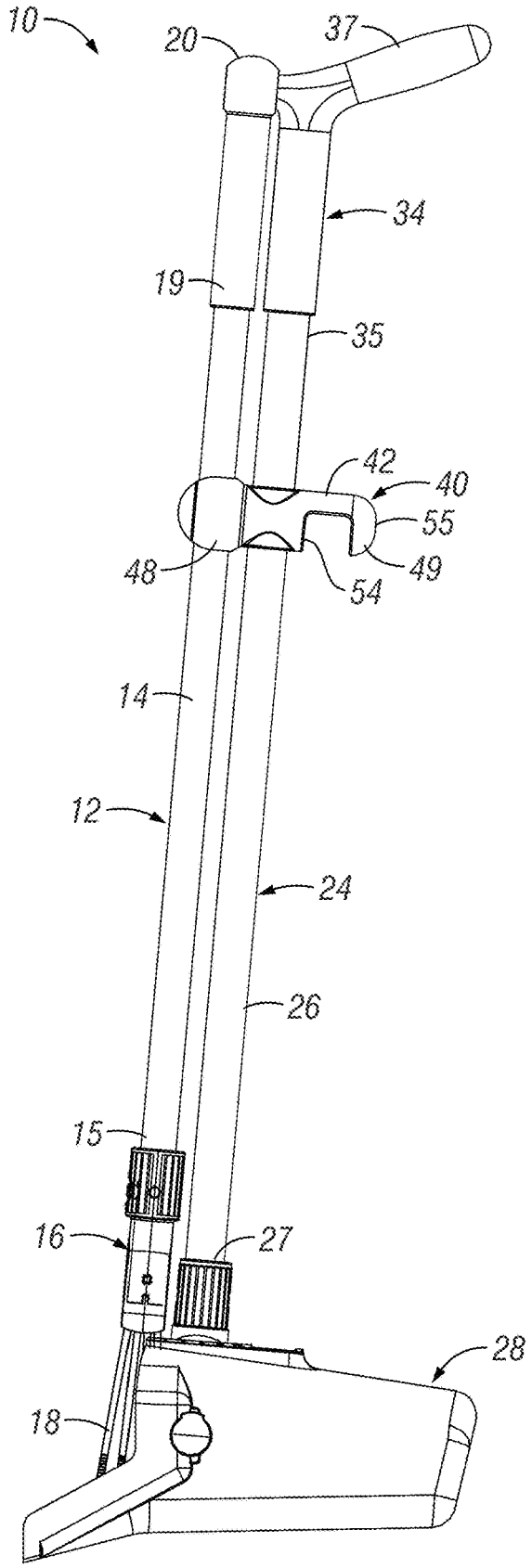
FIG. 4 is a side elevation view of FIG. 1.
Figure 5:
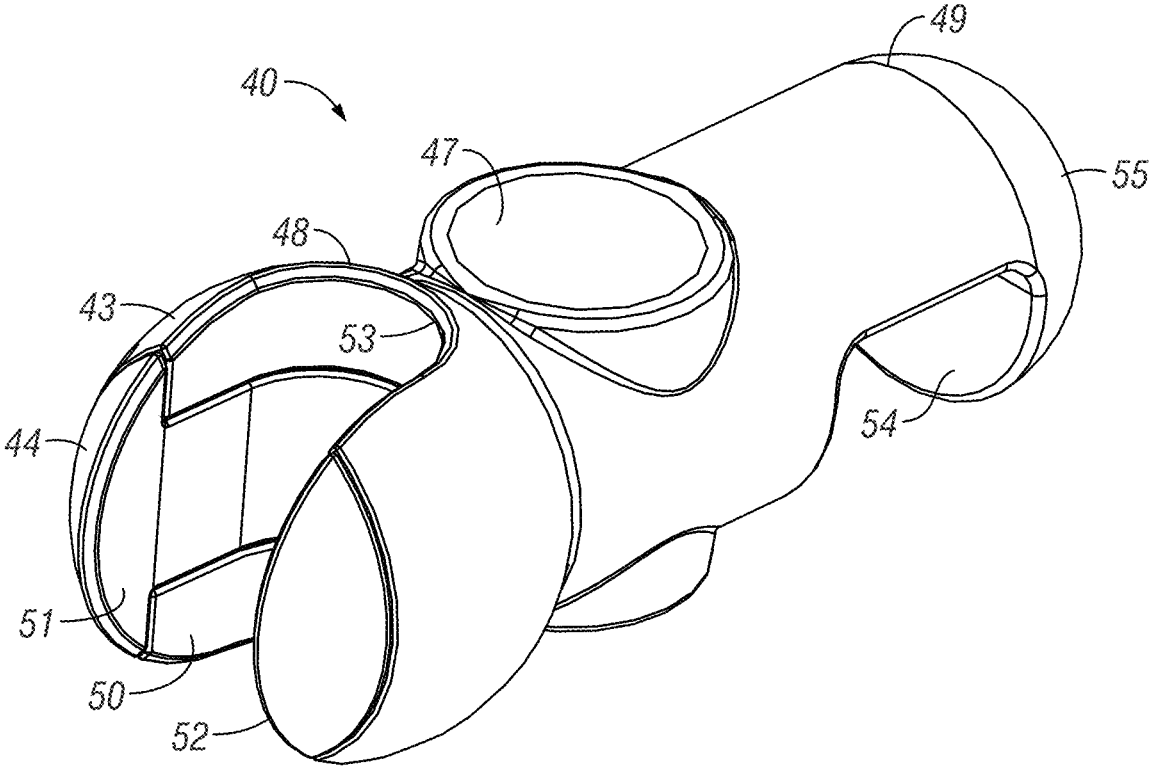
FIG. 5 is a perspective view of a clip assembly for use with the tool set of the present disclosure.
Figure 6:
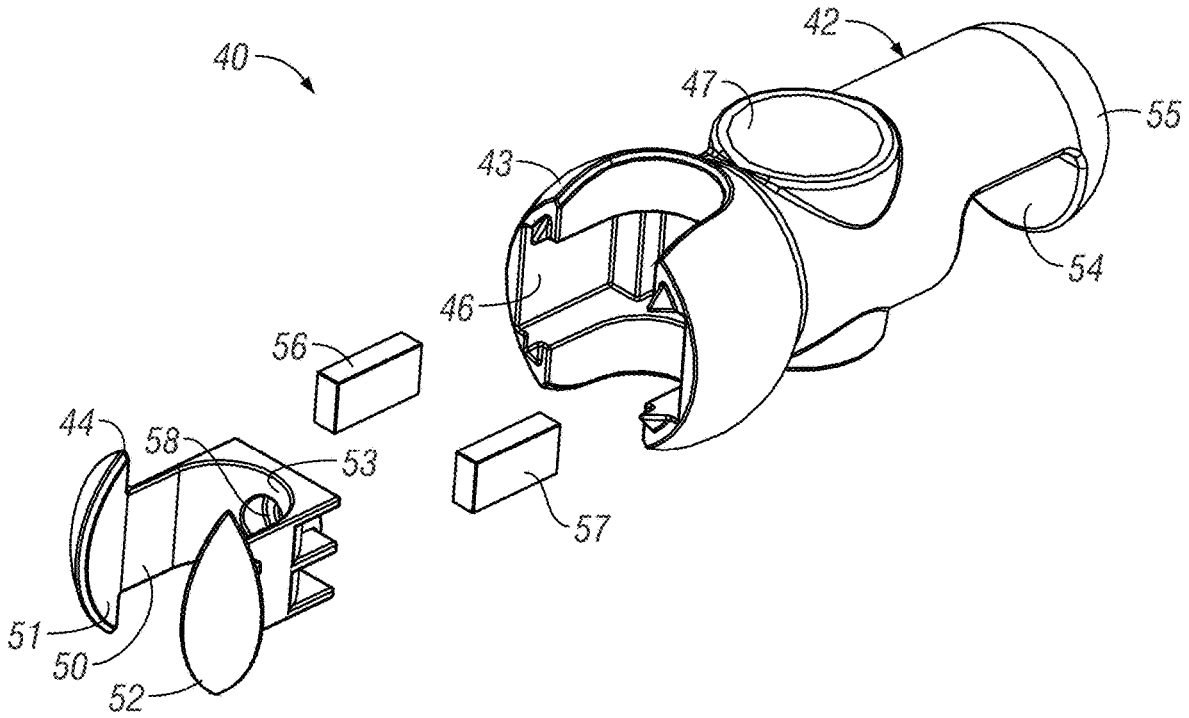
FIG. 6 is an exploded view of the clip assembly according to aspects of the disclosure.
Figure 7:
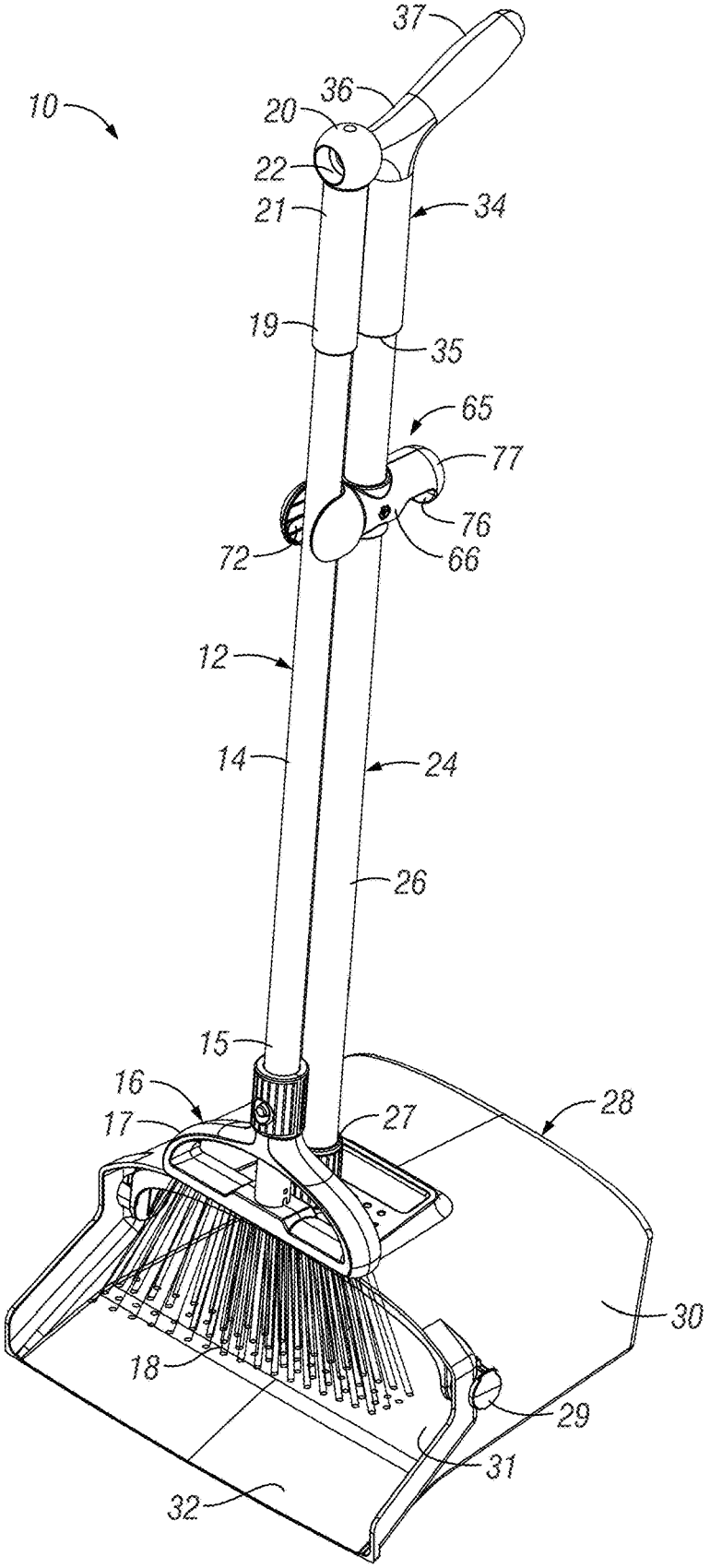
FIG. 7 is a perspective view of a floor care tool set according to additional aspects of the present disclosure.
Figure 8:
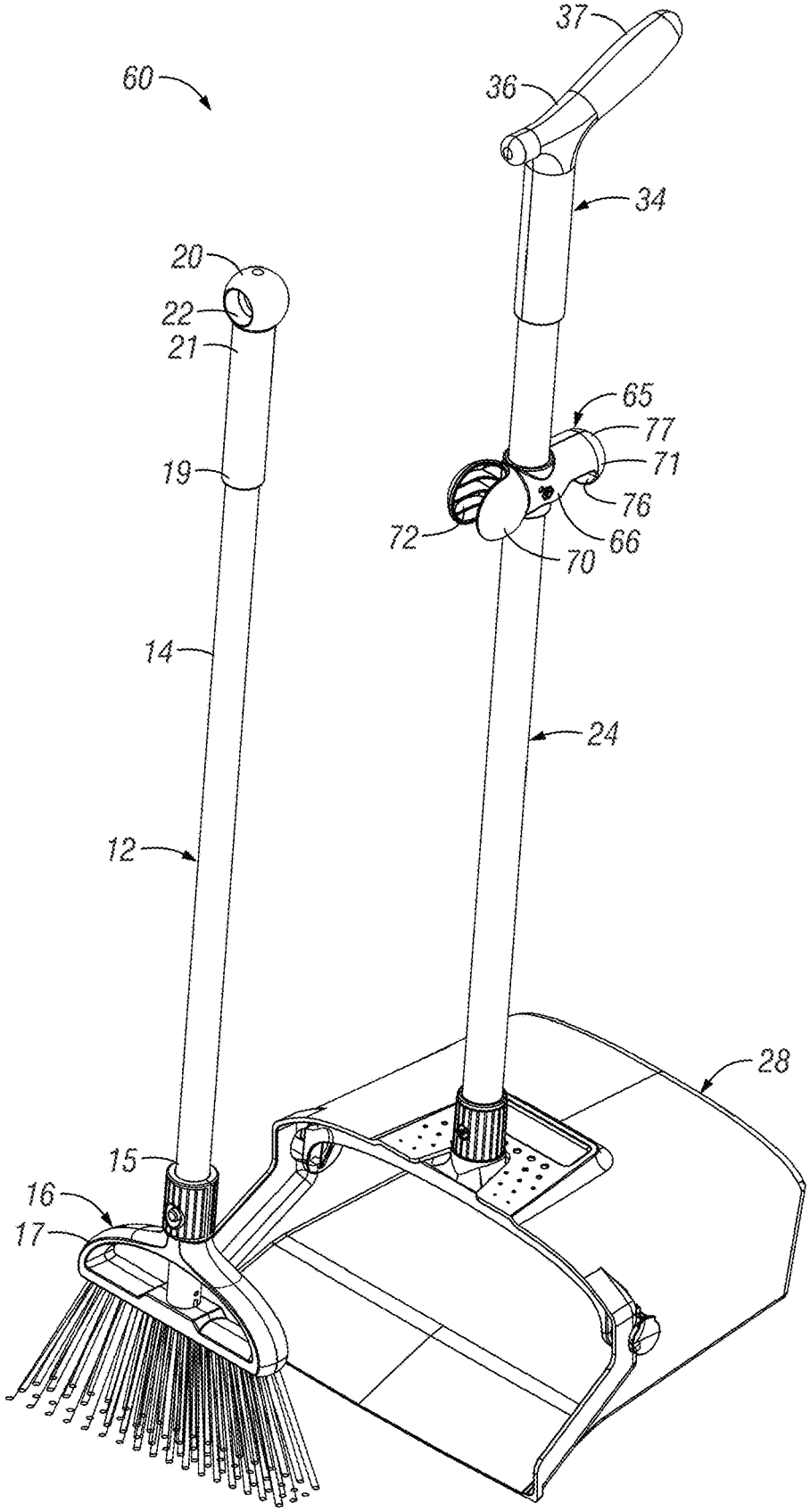
FIG. 8 is a view of the floor care tool set of FIG. 7 with components separated.
Figure 9:
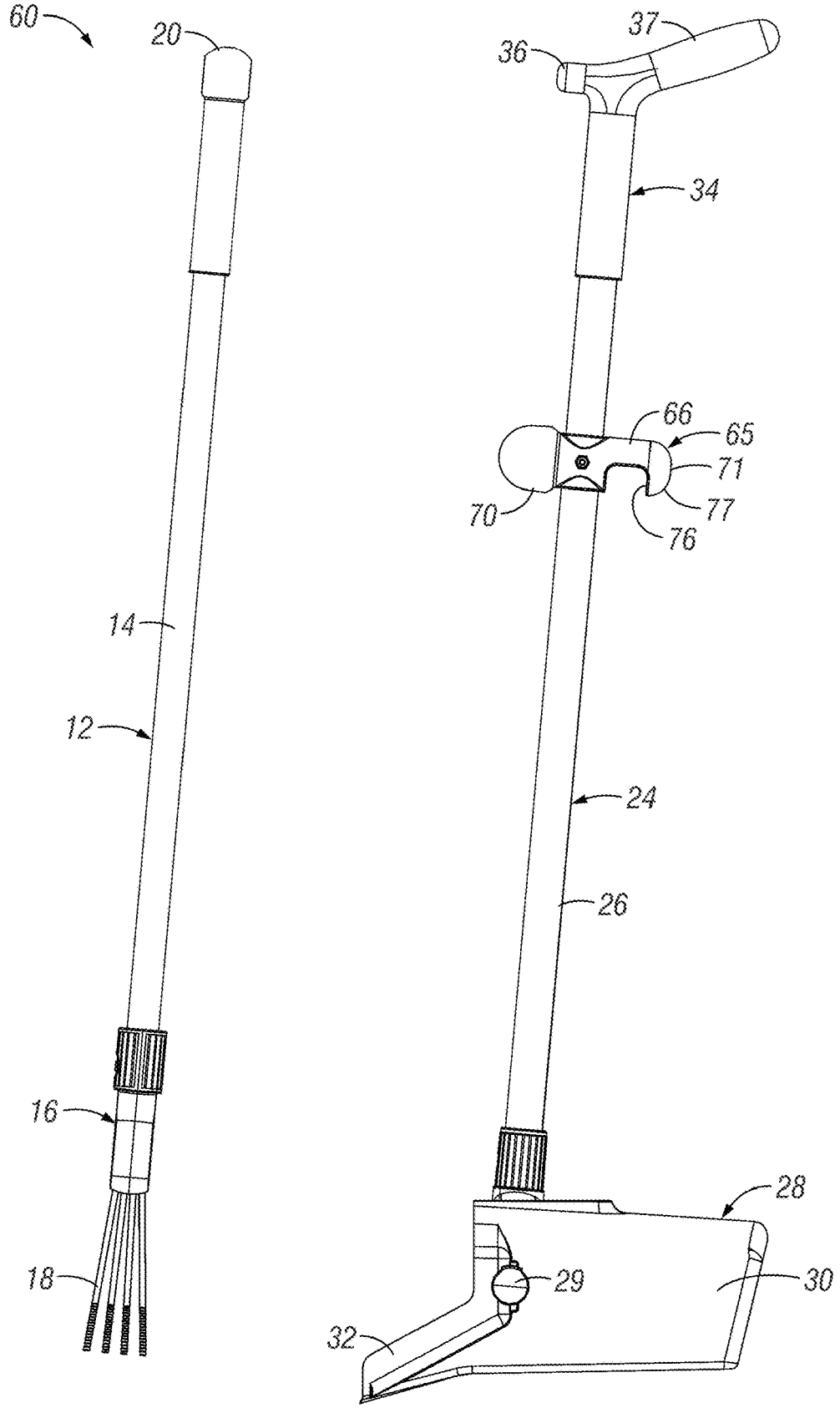
FIG. 9 is a side elevation view of FIG. 8.
Figure 10:
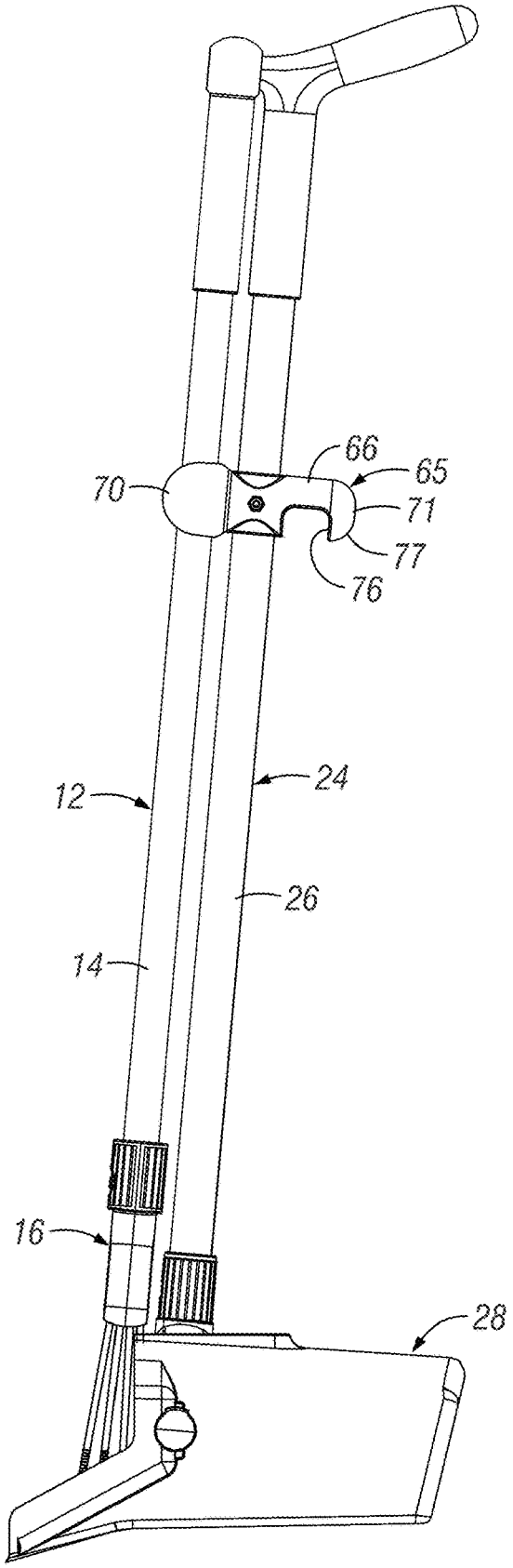
FIG. 10 is a side elevation view of FIG. 7.

Therefore, as shown in the FIGS. 1-4 and further in detail in FIGS. 5 and 6, a clip 40 is provided. The clip 40 includes a housing 42. As shown in FIGS. 5 and 6, the housing 42 may include a first portion 43 and a second portion 44 connected to one another, e.g., by a screw or other mechanical connection. The first and second portions 43, 44 of the clip housing 42 can be connected via a groove or slot 46 in the first housing 43 such as to provide orientation and direction for connecting the components of the housing together. The first portion 43 of the clip 40 also includes an aperture 47, such as for surrounding or at least partially surrounding a handle of the first or second floor care tools. While the Figures show an aperture almost substantially surrounding the handle, it should be appreciated that the aperture 47 could take the form of a clip being open or otherwise attaching to the elongated handle of the first or second floor care tool.

The clip 40 includes generally a first end 48 and a second end 49. Positioned at the first end 48 and shown being part of both the first and second portions 43, 44 of the housing 42, is a concave portion or surface 50. The concave portion 50 includes opposite first and second sides 51, 52 and an innermost section or point 53. The first side, second side, and innermost section comprise generally the U-shaped components of the concave portion 50. The concave nature of the first end 48 of the clip 40 provides a shape and receiving portion for surrounding or at least partially surrounding the opposite elongated handle to which the clip is not positioned. For example, as is shown in FIGS. 1-4, the clip is positioned on the second floor care tool handle, while the concave portion is extended to receive a portion of the handle of the first floor care tool. However, as has been disclosed, this can be reversed. The concave portion is configured to receive and at least temporarily hold the handle 14 of the first floor care tool 12 until such time as the components are to be used and can be separated. To aid and holding the first floor care tool handle 14 within the concave portion 50 of the clip 40, magnets 56, 57 are included, as is shown in FIG. 6. The magnets 56, 57 may be enclosed within one or more of the grooves or slots 46 in the first housing portion 43 and enclosed by the second housing portion 44. The magnets will interact with the steel of the handle 14 of the first floor care tool 12 to provide a magnetic connection/attraction between the clip 40 and the first floor care tool 12. Such magnetic attraction can be overcome by little force, and can be overcome to separate the floor care tools from one another. However, the attraction will provide for the temporary connection between the first and second floor care tools, such as when the tools are not in use. Therefore, the concave portion 50 and the magnetics work together to hold the handle of the first floor care tool within the concave portion 50 of the second floor care tool 24 to temporarily connect the floor care tools as a floor care tool set 10.

Additional holding mechanisms, besides magnets, could be used. For example, hook and loops, adhesives, hooks, snaps, friction fit, mechanical fasteners, and the like, could be utilized between the handle and the clip to connect the complementary tools of the set. Still further, magnets could be included within the handle of the tool opposite the clip, and wherein the magnets are oriented to have attraction between the magnets in the handle and the magnets in the clip to provide connection therebetween.

Additional aspects of the clip 40 include a hook or notch member 54. The hook or notch member 54 is positioned generally at or near the second end 49 of the housing 42. Such a hook or notch portion can be used to receive a lip or lip like surface of a component, such as a trash receptacle, wall, hanging apparatus, or the like. This will provide for a component to hang the floor care tool set 10 on. Therefore, the hook or notch portion can be varied in size, depth, and the like. Still further, at the second end 49 is a puck connector 55 portion. The puck connector 55 can be utilized to connect the clip 40 to a puck member 93, such as that will be shown and described herein. This provides for additional places to hang the floor care tool set 10, such as when not in use.

Still additionally, the clip 40 may include a screw aperture 58 for connecting the first and second portions 43, 44 of the housing 42 to connect thereto. Additional screws or apertures thereof can be included to provide attachment of the clip housing 42 to one of the elongated handles.

Figure 2:
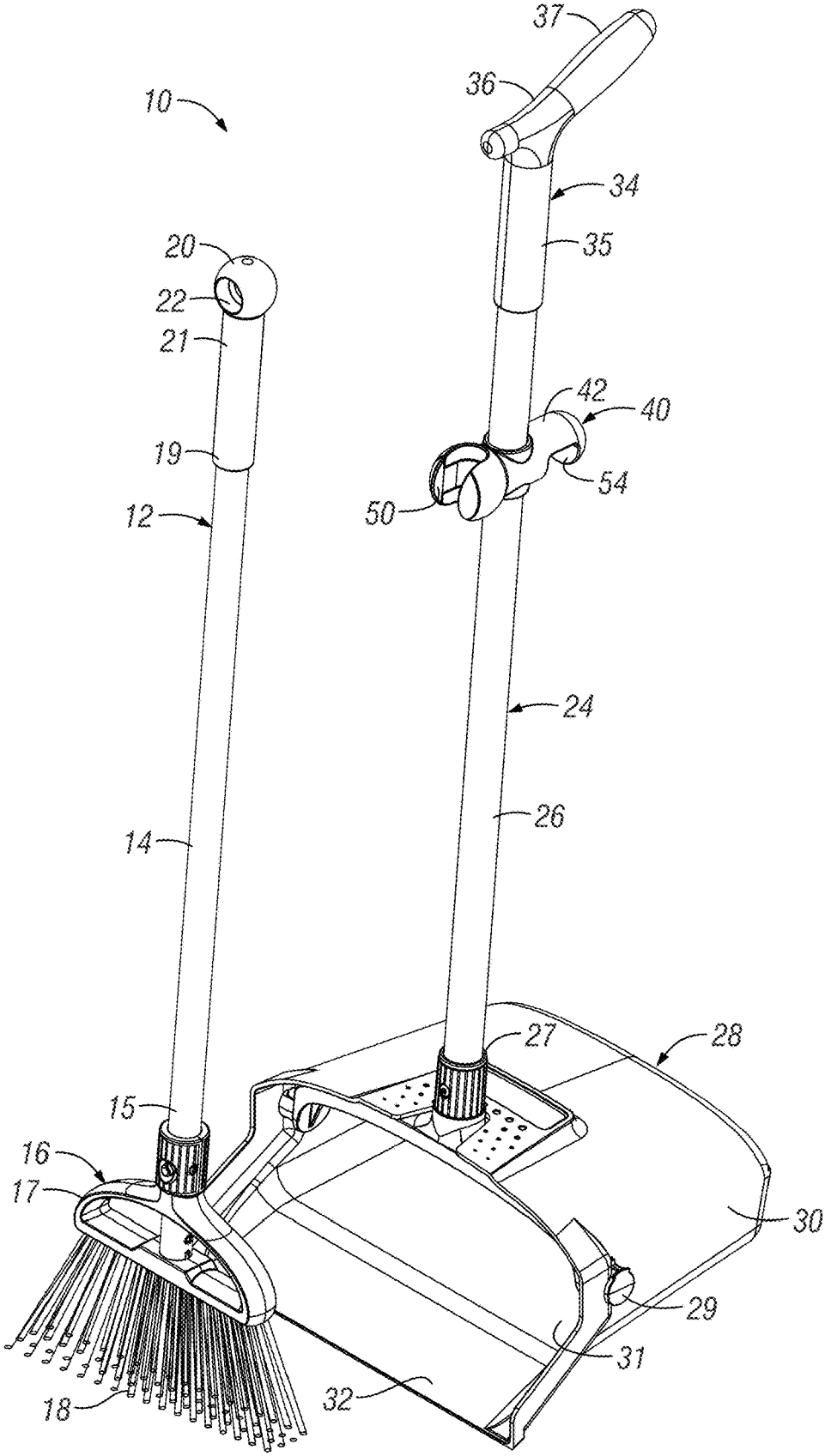
FIG. 2 is a view of the floor care tool set of FIG. 1 with components separated.

Therefore, FIGS. 1-4 show the floor care tools 12, 24 in various stages of connecting and disconnecting. As shown in FIGS. 2 and 3, the tools are disconnected, such as when they are to be used complementarily. FIGS. 1 and 4 show the tools generally connected to one another, which may be storage or otherwise non-use configuration. The handle 14 of the first floor care tool 12 is nestled or partially within the concave portion 50 of the clip 40 and can be maintained therein by use of such magnets. A second point of connection is shown by way of the grip 34 of the second floor care tool 24 and the mounting member 20 of the first floor care tool 12. As disclosed, the grip 34 includes a beak or other extension portion 36. This is configured to interact or otherwise be inserted into the aperture 22 of the mounting member 20. Such insertion of the beak 36 into the aperture 22 will provide a second point of connection between the first and second floor care tools to provide for additional stability for the connection.

Figure 11:
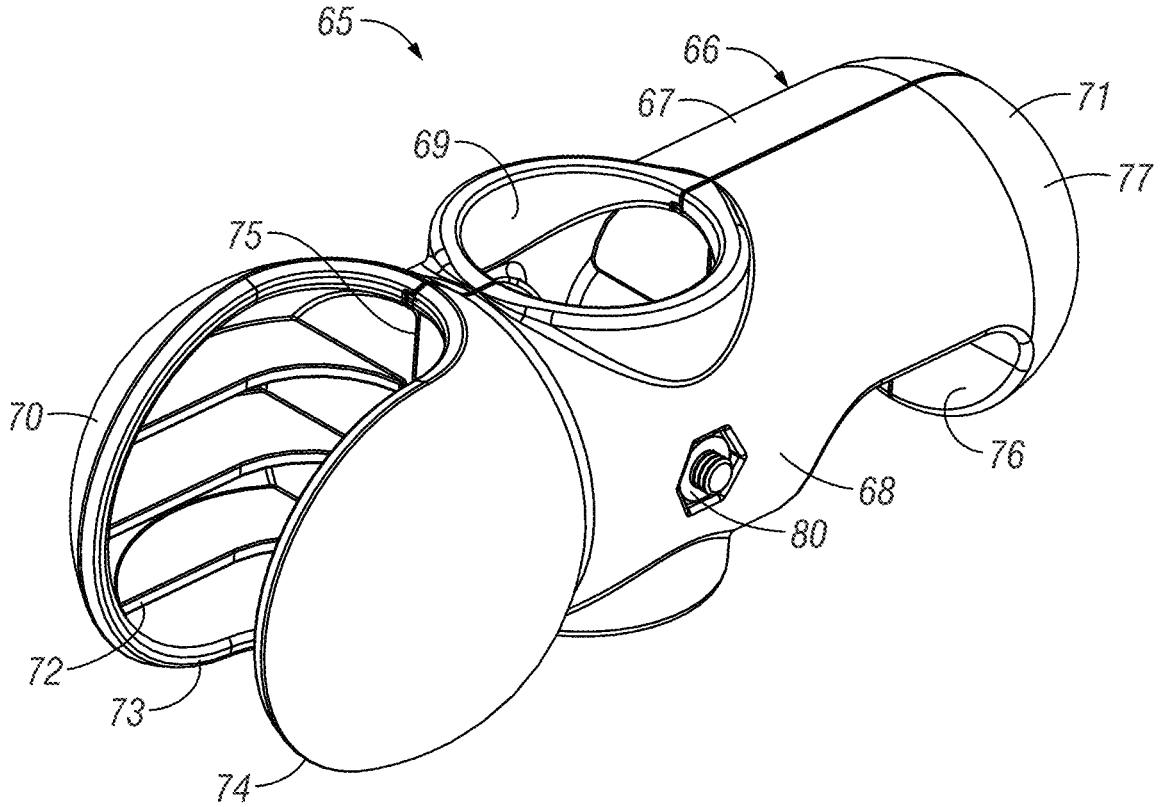
FIG. 11 is a perspective view of another clip assembly for use with the tool set of the present disclosure, showing additional aspects.

FIGS. 7-10 show additional aspects and/or embodiments of a floor care tool set 60 according to aspects of the present disclosure. The floor care tool set 60 shown in FIGS. 7-10 include many of the same features as that shown and described previously herein. The includes the use of the first and second floor care tools and components thereof. However, one change between the floor care tool set 60 and the floor care set 10 as previously disclosed is the use of the clip 65. The clip 65 is used in generally the same manner as that of the clip 40 as previously shown and described herein. However, the clip 65 includes additional aspects and/or embodiments that differ from the clip as previously shown and described. The clip, which is shown in greater detail in FIGS. 11 and 12, includes a housing 66. The housing includes a first portion 67 and a second portion 68. As is understood from the drawings, the housing portions of the clip 65 are split generally longitudinally along the length of the clip 65. This longitudinal split provides for the first and second housing portion 67, 68 to be generally connected around the handle of one of the first or second floor care tool. The housing can be connected to one another about the handle, such as by a screw in the aperture 80. There can be one or more screws, as is shown in the figures.

Figure 12:
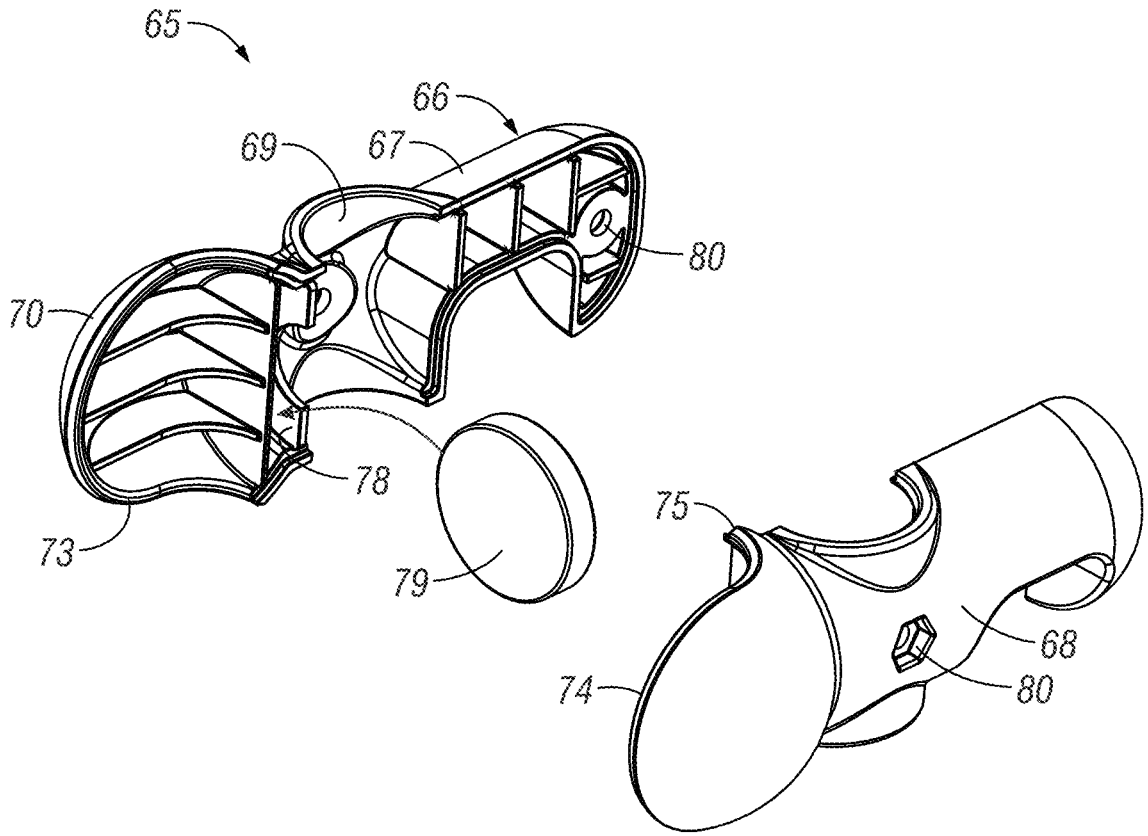
FIG. 12 is an exploded view of the clip assembly according to aspects of the disclosure.

However, the clip 65 includes generally many of the same or similar features as that previously shown and described herein. For example, the housing 66 includes the handle aperture 69, which is created by the connection of the first and second housing portions. There is a first end 70 and an opposite second end 71 of the clip 65. Generally, at or near the first end 70 is a concave portion or surface 72. The concave portion is a generally U-shaped or type area which is sized and configured to be able to receive an elongated handle, such as that shown with regard the first floor care tool 12. Therefore, the size and shape are not to be limited to that shown in the figures. The concave portion 72 includes a first side and opposite second side 73, 74 and inner most sections 75. As shown in FIG. 12, with the first and second housing portions 67, 68 separated, there is a notch 78 created between the first and second housing portions positioned within the notch 78 is a magnet 79, which is shown to be generally a cylinder-shaped magnet. The magnet 79 is configured to fit between the first and second housing sections within the notch 78, and at or near the inner most section 75 of the concave portion 72. The magnet 79 will interact with the handle of a floor care tool position within the concave portion to provide an attraction therein to at least temporarily connect and hold the handle within the concave portion. Therefore, the magnet can take many shapes, forms, and/or sizes, but it is generally used to provide attraction to the handle to provide adherence thereto.

Other aspects of the clip 65 include the hook or notch 76 generally at the second end 71 of the clip 65. The clip also includes a connector portions 77 at the second end as well. Therefore, the clip 65 is used to connect to the handle to provide attraction in between the steel of the handle. As mentioned, the steel can be a steel outer surface or can be a steel sleeve inside an aluminum handle to be attracted to the magnets.

Still further, the floor care tool set 60 as shown in FIGS. 7-10 includes the grip 34 with the beak 36 to interact and/or accept the aperture 22 of the mounting member 20 of the first floor care tool 12 in order to provide a second point of connection to provide stability thereof.

Figure 13:
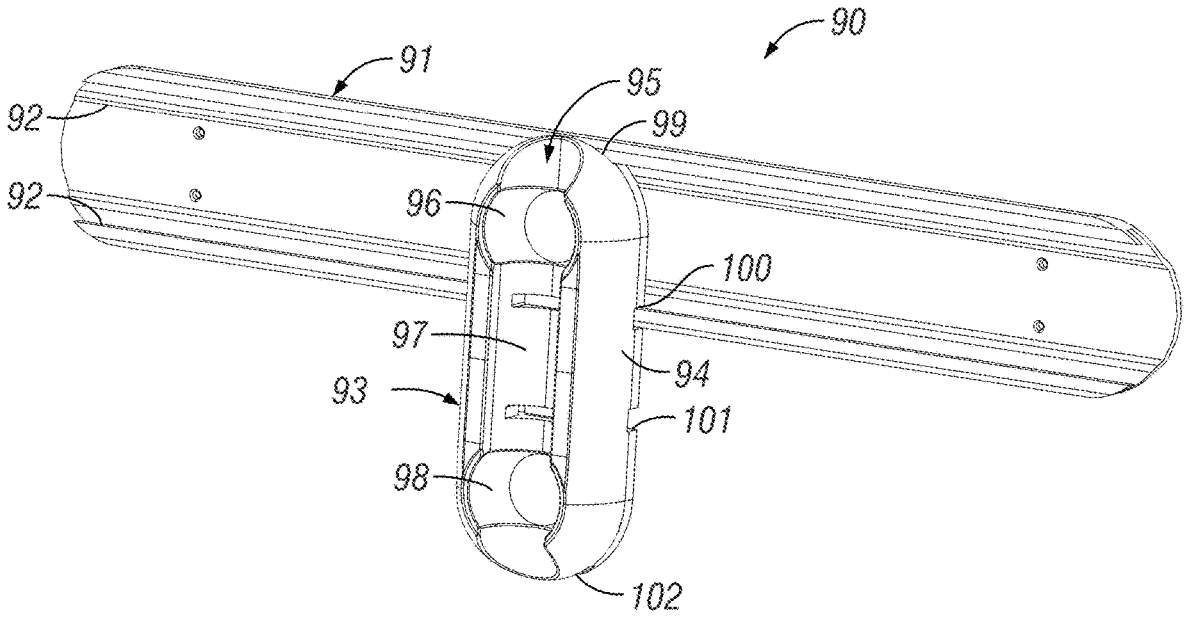
FIG. 13 is a perspective view of a mounting puck and rail for mounting a floor care tool assembly.
Figure 14:
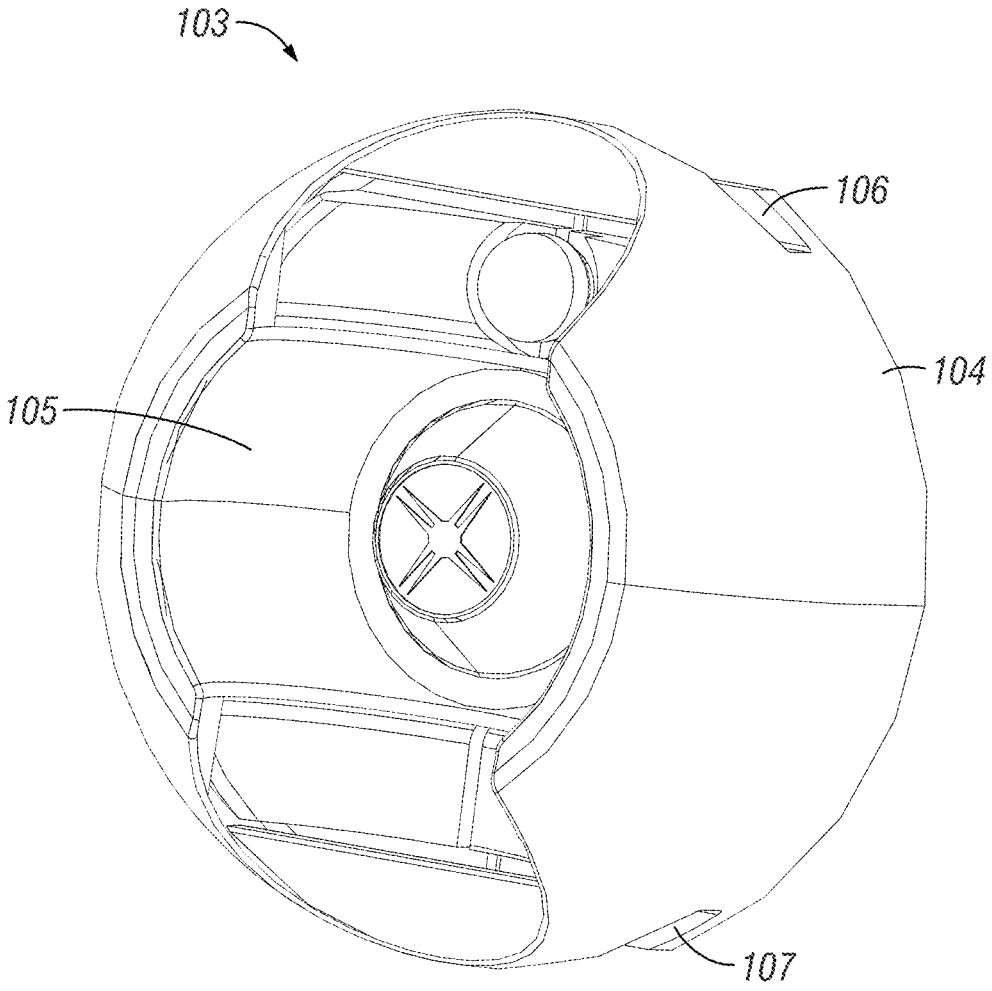
FIG. 14 is a perspective view of a single puck member.
Figure 15:
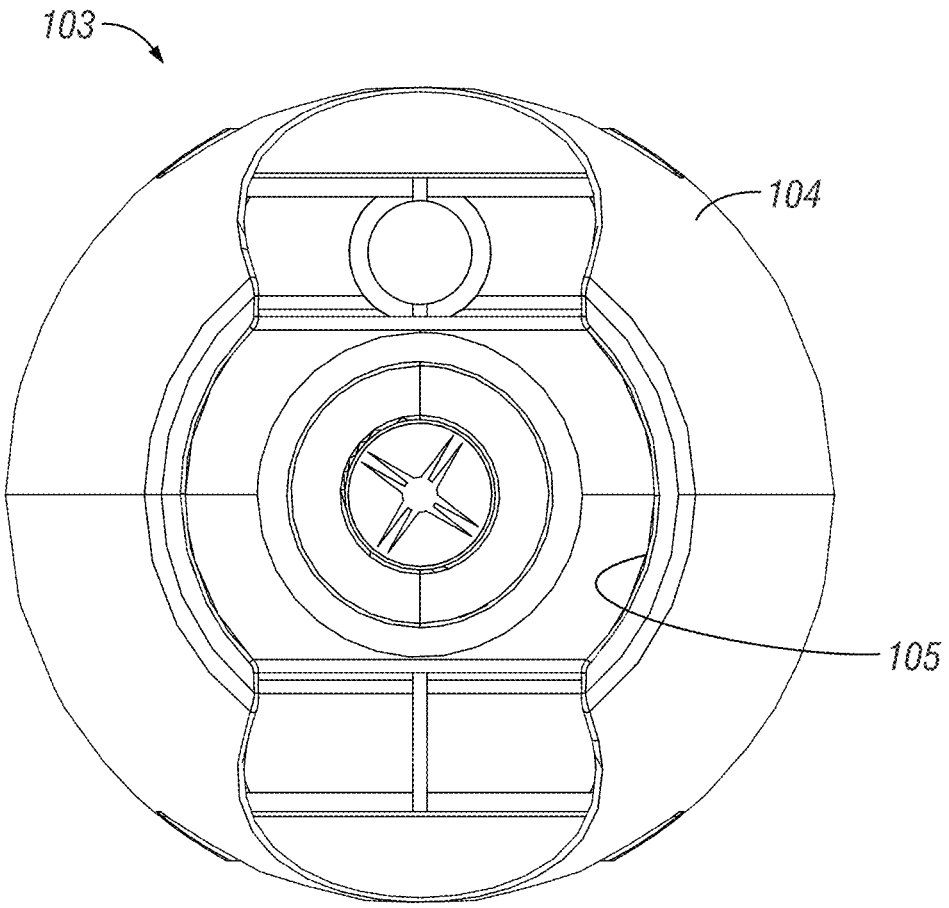
FIG. 15 is a front elevation view of the puck member.
Figure 16:
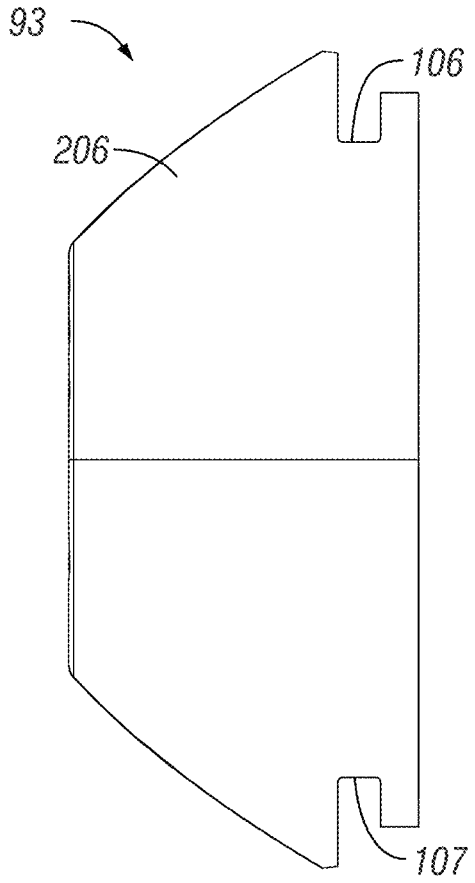
FIG. 16 is a side elevation view of the puck member.

Therefore, the clips 40, 65 are used to connect complementary style floor care tools to one another to create a floor care tool set which can be used to connect the complementary tools to one another to provide for a known combination thereof which can provide for additional efficiency of use and/or storage of the tool set. As has been mentioned herein, the clips 40, 65 can be attached to a hanging mechanism, such as a puck 93,103 to store the floor care tool set 10, 16 not in use. Therefore, FIGS. 13-16 provide additional aspects which are shown and described in the U.S. application Ser. No. 14/996,993, which is hereby incorporated in by reference in its entirety and for all intents and purposes. FIG. 13 discloses a mounting assembly 90, which can be used to attach to the connectors 55, 77 of the clips 40, 65 in order to store or otherwise hang the tool sets. As shown in the figure, a puck member 93 is attached to a rail 91. The rail 91 includes channels extending upwardly and downwardly from upper and lower portions of the rail 91. The puck 93 includes notches in a back side thereof that slides said puck 93 relative to the portions of the rail 91. It is noted that the number of notches found on the puck 93 allow it to be positioned in different manners, such as with the puck extending below the rail 91 or the puck being positioned generally above the rail system. Furthermore, the puck 93 includes receiving pockets for receiving a portion of the clip, such as in a ball and socket manner. Therefore, the mounting assembly 90 includes a rail 91 with a puck 93 attached thereto. The rail 91 includes channel portions 92 which can interact with notches of the puck 93 to allow the puck to be slid on to and about the rail 91. For example, the puck 93 including a puck body 94 can include a first notch 99, second notch 100, third notch 101, and fourth notch 102. The notches are spaced similar to the rail extrusions such that the notches fit on and slide about the rail at the notches. In addition, the spacing of the notches allow the puck to be placed in different configurations relative to the rail. This can include with the puck being generally positioned below the rail, as is shown in FIG. 13. However, this generally provide for three different configurations or hides the puck relative to the rail system. As can be appreciated, the different heights of the puck relative to the rail can allow for staggering of the floor care tool set 10. Furthermore, the puck body 94 includes a receiving portion or pocket 95. In addition, there may be first, second, and third receiving portions 96, 97, and 98. The receiving portions can interact with the clip to be positioned therein. FIGS. 14-16 show another aspect of the mounting member, which includes a single puck 103. The single puck can be used in conjunction with the puck 93, or in the stand alone manner, such as when attaching a single tool or tool component to a rail or to a position on the wall. For example, this single puck can be used independent of the rail to be adhered to a wall for attachment thereto. Such a single puck can therefore be standalone mounted for single use applications, such as attached with an adhesive or mechanical fastener to a particular surface or location without the use for a rail. The puck will also include notches 106, 107, for interaction with the rail 91, when used therein. This allows the puck to be slide on the rail into a particular location of choice. A pocket 105 allows for interaction with the mounting member 20 or else the connections 55, 77 of the clips 40, 65 to be attaching the floor care tools set thereto.

Furthermore, the puck could be without any grooves, and can be mounted directly to a wall via adhesive or mechanical means/fasteners (e.g., screws, pins, nails, etc.).

Thus, the clips and other aspects of the disclosure provide numerous advantages and/or improvements over prior clips or other means which have been used to combine tools. The clips can be easily attached to any one of a handle of a tool that may be used in conjunction with or otherwise in a complementary fashion with another tool that may also have an elongated handle. The clips, therefore, can be retrofit for use with existing tools, and may not be limited to cleaning or floor care type tools. The attachment of the tools overcome issues associated with misplacement or separation of such tools, among other benefits.

Therefore, before going description has included aspects and embodiments for a floor care tool set including an apparatus, system, and methods for connecting complementary tools to one another. The description has been presented for purposes of illustration and description, and is not intended to be an exclusive or exhausted list or to limit the disclosure to the precise forms disclosed. It is contemplated that other alternative processes, systems, and assemblies obvious to those skilled in the art are to be considered part of the disclosure. It is understood that the disclosure includes numerous advantages, as has been shown and described.

What is claimed is:

1. A floor care tool set, comprising:

a first floor care tool comprising an elongated handle with a first floor care tool head positioned at a first end of the handle;

a second floor care tool comprising an elongated handle and a second floor care tool head positioned at a first end of the handle;

a clip attached to the handle of the first or second floor care tool, said clip comprising a housing operatively connected to the handle with said housing including a concave portion for receiving a portion of the first or second handle, and at least one holding element associated with the concave portion to hold one of the first or second handles within the concave portion;

a mounting member positioned at a second end of the first floor care tool handle; and a grip positioned at the second end of the second floor care tool, said grip comprising an extension that intersects the mounting member of the first floor care tool.

2. The floor care tool set of claim 1, wherein said clip is attached to the second floor care tool, and the concave portion of the clip is configured to receive a portion of the handle of the first floor care tool.

3. The floor care tool set of claim 1, wherein the at least one holding element comprises at least one magnet operatively positioned with respect to the clip housing.

4. The floor care tool set of claim 3, wherein the at least one magnet is positioned at or near the interior-most point of the concave portion.

5. The floor care tool set of claim 3, wherein the at least one magnet comprises first and second magnets positioned generally across from one another and interiorly facing with respect to the concave portion.

6. The floor care tool set of claim 1, wherein the handle of the first and second floor care tools comprises steel.

7. The floor care tool set of claim 1, wherein the clip comprises a hook opposite the concave portion.

8. The floor care tool set of claim 1, wherein the first floor care tool head comprises a broom, and the second floor care tool comprises a receptacle.

9. The floor care tool set of claim 1, wherein the grip includes an elongated hand portion opposite the extension, wherein said elongated hand portion is configured to fit a contour of a user's hand.

10. In combination, a first floor care tool comprising an elongated handle, and a second floor care tool comprising an elongated handle, the combination comprising:

a clip for temporarily connecting the first and second floor care tools, said clip comprising:

a housing surrounding the handle of the first or second floor care tool;

a concave surface extending from a first end of the housing;

a generally downward facing hook on a second end of the housing; and a holding element operatively positioned relative to the concave surface to temporarily connect the first and second floor care tools, said holding element being positioned in the housing and being independent and separate from the housing; and wherein the holding element comprises first and second magnets within the housing on opposite sides of the concave surface.

11. The combination of claim 10, wherein the holding element comprises a magnet within the housing.

12. The combination of claim 11, wherein the magnet is positioned opposite the opening of the concave surface.

13. The combination of claim 10, wherein the housing comprises first and second sections attached to one another around a portion of the handle of the first or second floor care tool.

14. The combination of claim 10, further comprising a hanging element, wherein said hanging element is operatively connectable to the second end of the housing of the clip.

15. A floor care tool set, comprising:

a first floor care tool comprising an elongated handle with a first floor care tool at a first end of the handle;

a second floor care tool comprising an elongated handle with a second floor care tool at a first end of the handle; and a clip attached to a portion of the handle of the second floor care tool, said clip comprising a housing attached to the handle, a generally concave portion extending from a first end, a holding element associated with the concave portion, and a second end having a notch or hook;

wherein the clip connects the first and second floor care tools by removably attaching the handle of the first floor care tool at least partially within the concave portion of the clip and being held, at least in part, by the holding member, said holding member being positioned in the housing and being independent and separate from the housing; and wherein the holding element comprises first and second magnets on opposite inner sides of the concave portion of the clip, and said handle of the first floor care tool comprising steel.

16. The floor care tool set of claim 15, wherein said first floor care tool comprises a broom and said second floor care tool comprises a receptacle.

* * * * *